United States Patent [19]

Pettersson

[11] 4,260,345

[45] Apr. 7, 1981

[54] ARRANGEMENT FOR CASTING CONCRETE WALLS

[76] Inventor: John P. Pettersson, Pl. 1130, 760 15 Gräddö, Sweden

[21] Appl. No.: 68,437

[22] Filed: Aug. 21, 1979

[30] Foreign Application Priority Data

Sep. 4, 1978 [SE] Sweden ..... 7809292

[51] Int. Cl.[3] ..... E04G 11/22; E04G 11/24

[52] U.S. Cl. ..... 425/65; 249/20

[58] Field of Search ..... 425/62, 63, 64, 65, 425/60; 249/10, 11, 12, 13, 14, 15, 16, 17, 18, 19, 20, 21, 22

[56] References Cited

U.S. PATENT DOCUMENTS

| | | | |
|---|---|---|---|
| Re. 29,945 | 3/1979 | Scott | 249/16 X |
| 783,928 | 2/1905 | Clingan | 249/20 X |
| 1,075,454 | 10/1913 | Whipple | 249/17 X |
| 1,784,422 | 12/1930 | Fabre | 425/65 |
| 1,862,544 | 6/1932 | McWane | 249/20 X |
| 2,621,389 | 12/1952 | Von Heidenatam et al. | 425/65 |
| 3,224,065 | 12/1965 | Cheskin | 249/20 X |
| 3,252,199 | 5/1966 | Bössner | 425/65 |
| 3,583,666 | 6/1971 | Horstketter | 249/20 X |
| 3,632,079 | 1/1972 | Rahlf | 249/17 X |
| 3,901,472 | 8/1975 | Ahlgren | 425/63 X |
| 4,076,778 | 2/1978 | Whitting | 425/63 X |
| 4,128,610 | 12/1978 | Ahlgren | 425/63 X |

FOREIGN PATENT DOCUMENTS

| | | | |
|---|---|---|---|
| 902188 | 1/1954 | Fed. Rep. of Germany | 249/10 |
| 1082725 | 6/1961 | Fed. Rep. of Germany | 425/63 |
| 1162982 | 4/1958 | France | 249/10 |
| N 76407 | 9/1961 | France | 425/63 |
| 1278074 | 10/1961 | France | 425/63 |
| 257350 | 8/1926 | United Kingdom | 425/63 |
| 218401 | 9/1968 | U.S.S.R. | 249/20 |
| 375361 | 3/1973 | U.S.S.R. | 425/64 |
| 486120 | 9/1975 | U.S.S.R. | 425/63 |

*Primary Examiner*—J. Howard Flint, Jr.

*Attorney, Agent, or Firm*—Silverman, Cass & Singer, Ltd.

[57] ABSTRACT

An arrangement for casting concrete walls, comprising a beam system (1,50), which is capable to carry two form halves (2,3,51,52), between which concrete is to be poured. According to the invention a guide pipe (13,56) is located between the form halves and can be moved and preferably be locked relative to and at the beam system (1,50). The guide pipe (13,56) has a length corresponding to at least 1.5 times the height of the form halves (2,3,51,52). During the casting, the guide pipe (13,56) is located with its upper end above the uppermost level of the form halves and with its lower end, when a portion above an underlying wall portion (30) is being cast, projects down such a distance into a hole (31) formed at the casting of the underlying wall portion (30) that the upward transport of the beam system (1,50) is guided and its position relative to the underlying wall portion (30) is stabilized by the guide pipe (13,56), and at the absence of an underlying wall portion the lower end is located substantially on the same level as the lowermost level of the form halves (2,3,51,52) so as to effect said guiding and stabilization.

5 Claims, 10 Drawing Figures

ARRANGEMENT FOR CASTING CONCRETE WALLS

This invention relates to an arrangement for casting concrete walls.

Concrete walls often are cast by using either a so-called climbform or a slipform. A climbform substantially comprises two parallel walls, so-called form halves, between which concrete is poured. The form halves according to certain embodiments are supported on a carrying structure common to the halves, which structure in its turn in most cases is supported on struts against the ground or a cast concrete floor. For lifting such a climbform cranes are employed.

A slipform, distinguished from a climbform, is arranged so as to successively slide upward while concrete is being poured substantially continuously or at uniform time intervals. When using climbforms as well as slipforms, it is difficult to cast entirely plane walls, mostly vertical ones, without requiring the erection of substantial strutting and staying structures. Climbforms mostly are strutted both from the ground and from a cast lower wall portion already solidified.

Slipforms used for casting, for example, rectangular shafts require the erection of a plane or a lattice work stiff against torsion, which interconnects the slipforms for the different walls in order to prevent deviation in vertical direction.

The present invention implies that strutting and staying structures to a large extent can be eliminated, and the forms in general can be handled more simply. The invention further renders considerable cost-savings possible.

The present invention relates to an arrangement for casting concrete walls, comprising a beam system, a so-called working plane, which is capable to carry below it via struts two form halves, between which concrete is to be poured.

The invention is characterized in that between the form halves a guide pipe is provided, which is movable and lockable relative to and at said beam system, and which has a length corresponding to at least 1.5 times the height of the form halves, that during the casting the guide pipe is located with its upper end above the uppermost level of the form halves and with its lower end either projects into a hole formed at the casting of an underlying wall portion such a distance, that upward transport of the beam system is guided and its position relative to the underlying wall portion is stabilized by said guide pipe, or at the absence of an underlying wall portion the lower end of the guide pipe is located substantially on the same level as the lowermost level of the form halves.

Figure 1:
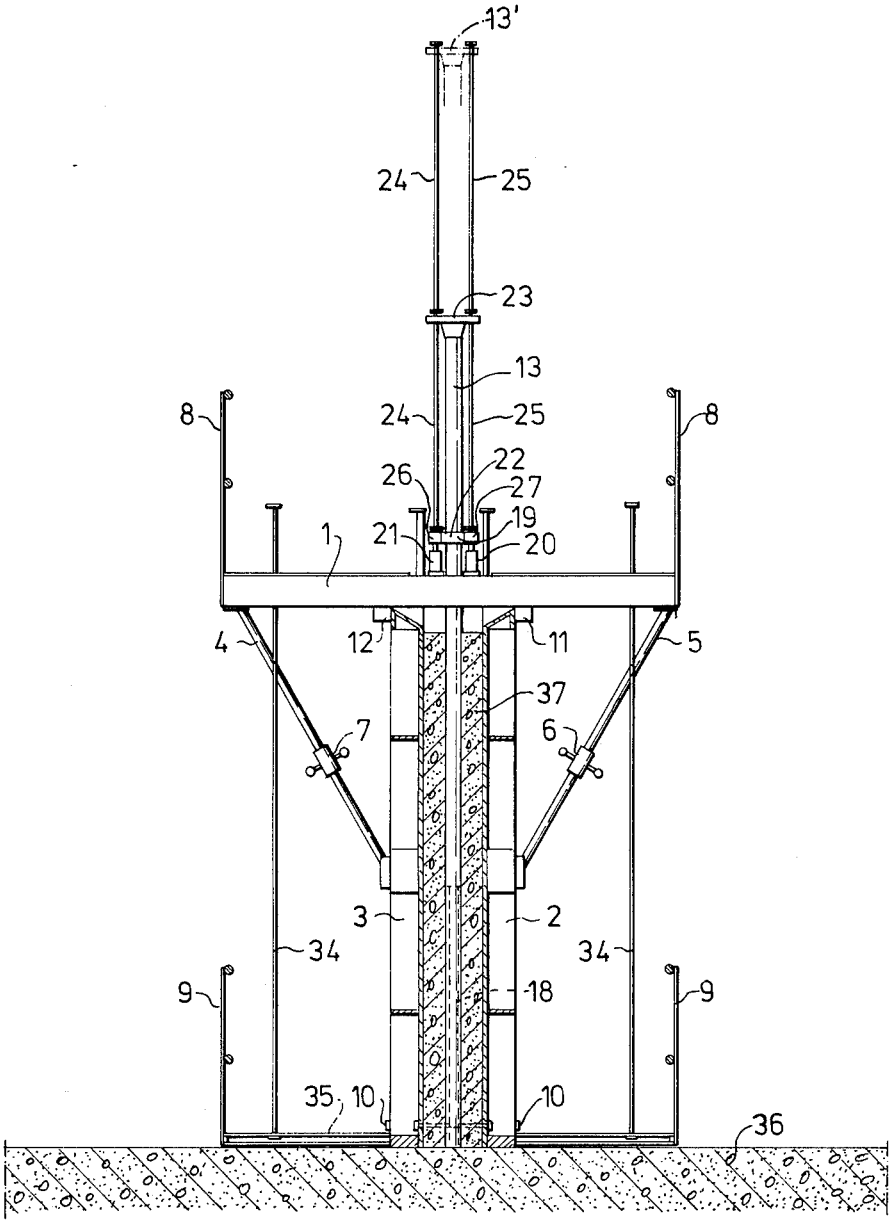
Figure 2:
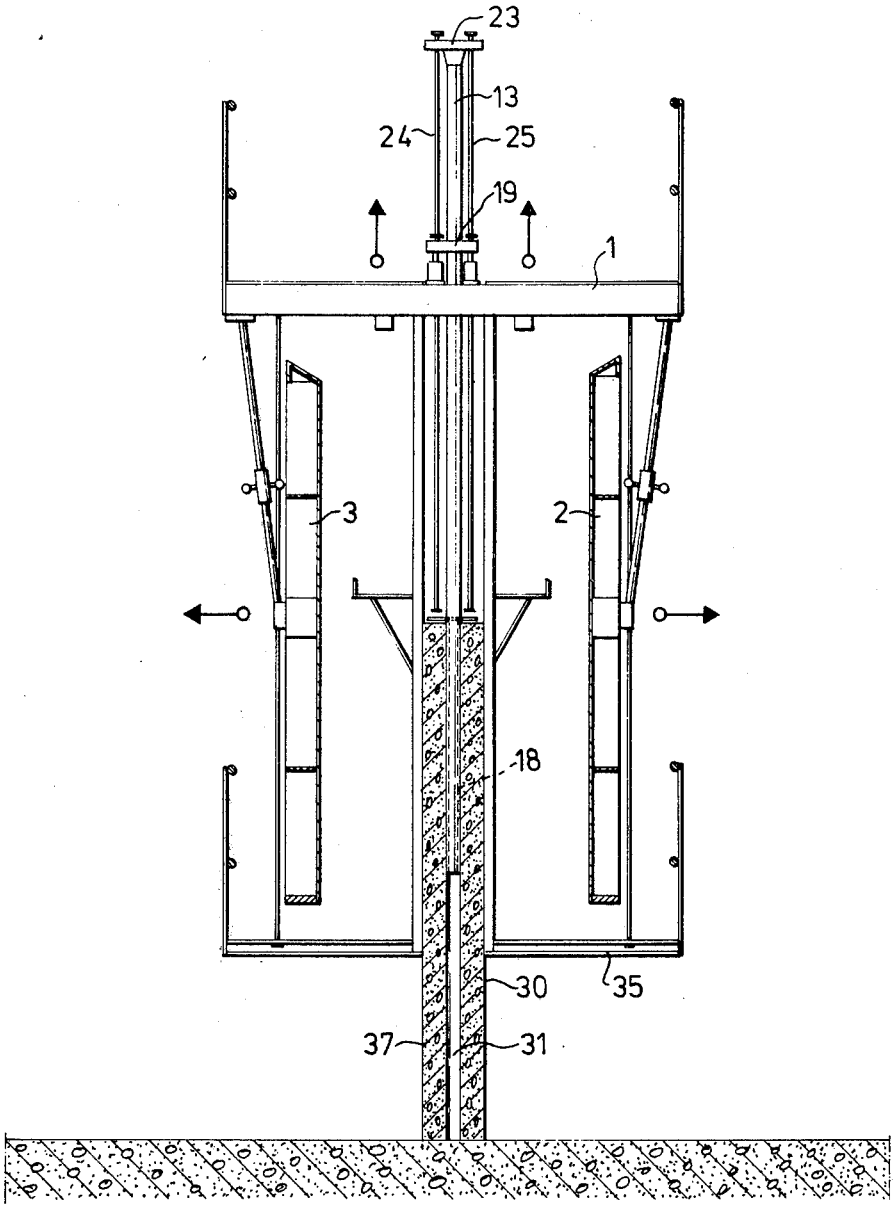
Figure 3:
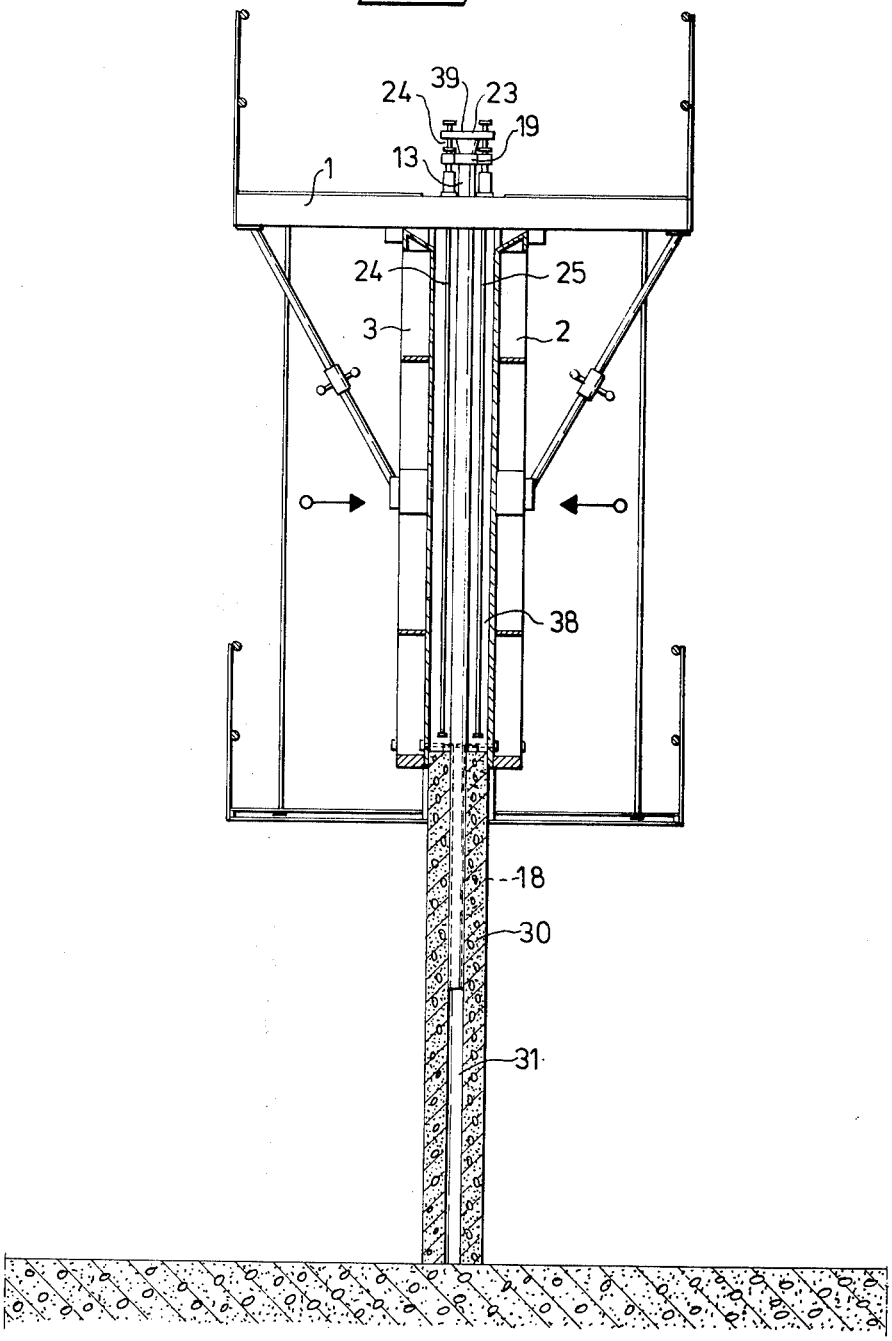
Figure 4:
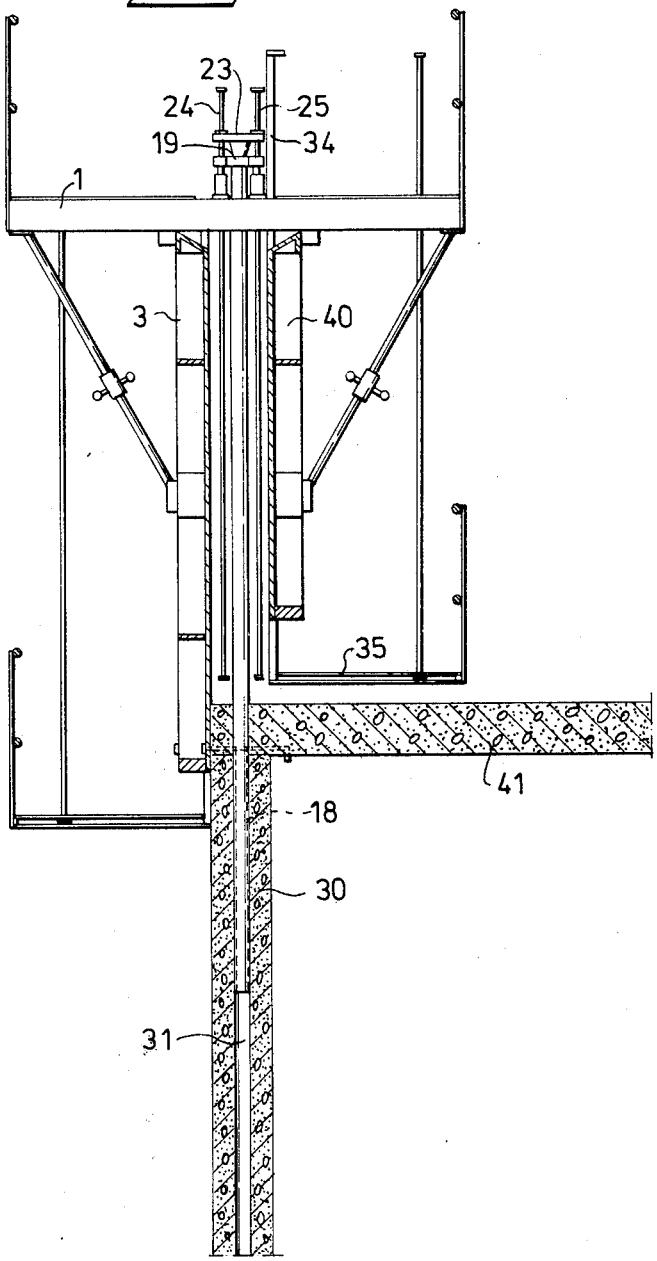
Figure 5:
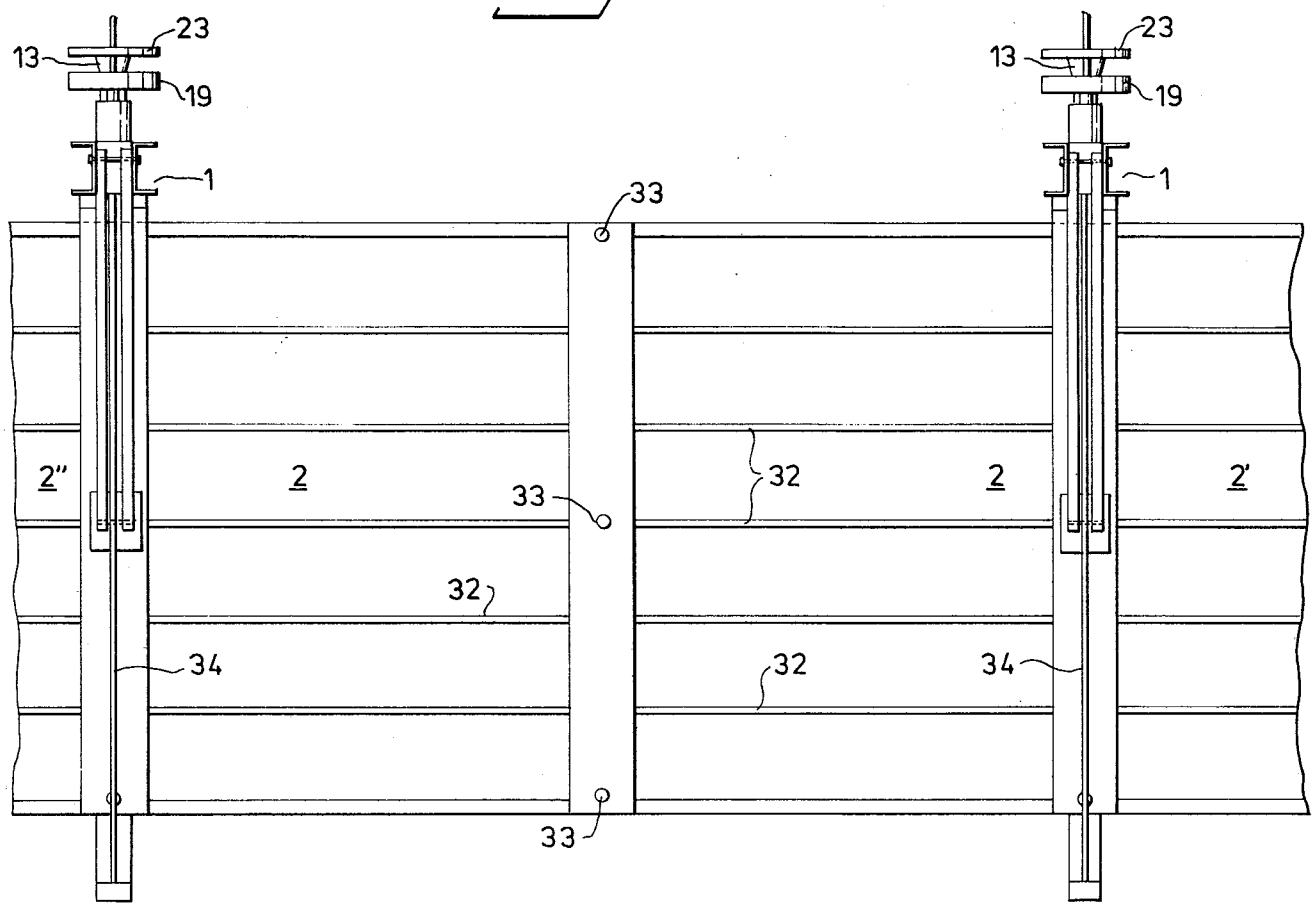
Figure 6:
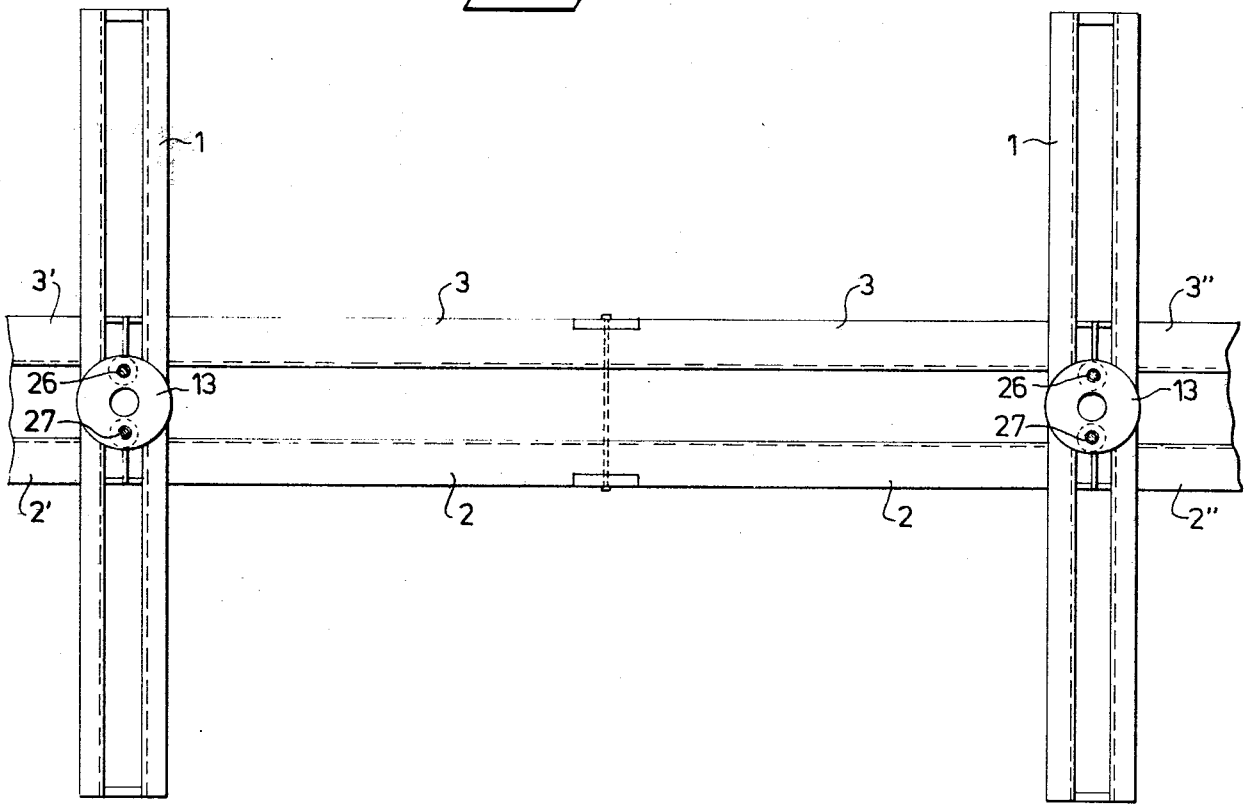
Figure 7:
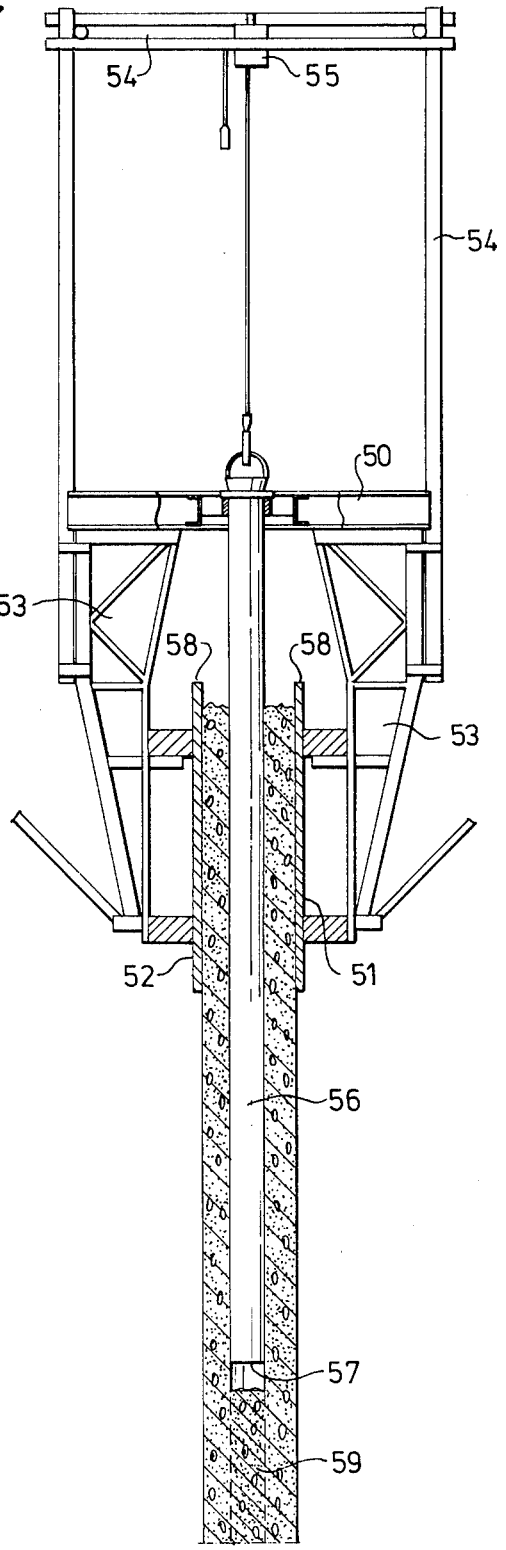
Figure 8:
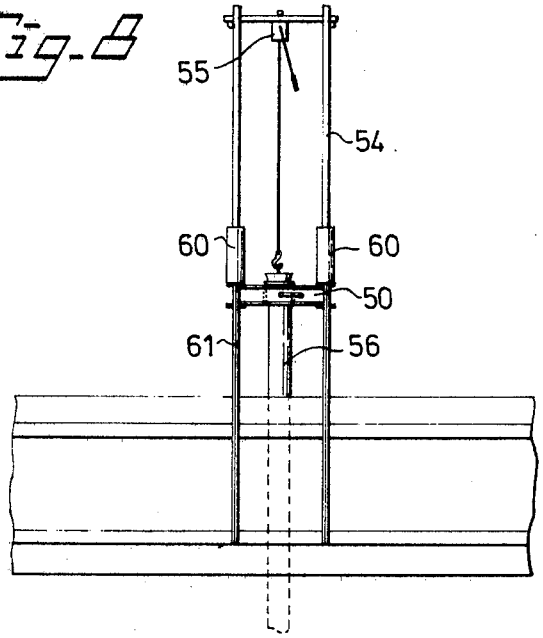
Figure 9:
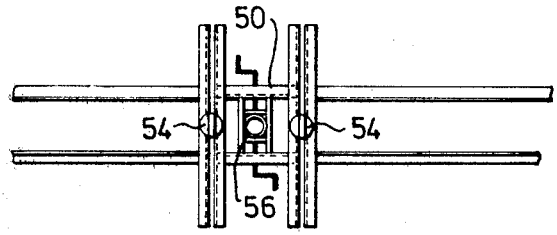
Figure 10:
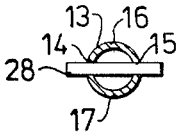

The invention is described in greater detail in the following, with reference to the accompanying drawings, in which FIGS. 1-3 show in sequence a climbing form, at which the present invention is used, FIG. 4 is a sectional view of a climbing form in a position where an underlying arch is cast, FIG. 5 is a lateral view of a climbing form, FIG. 6 is a plane view of a climbing form, FIG. 7 is a sectional view of a slipform, FIG. 8 is a lateral view of a slipform, FIG. 9 is a plane view of a slipform, FIG. 10 is a cross-section of a guide pipe where it is slitted.

In FIG. 1 a climbing form is shown, at which the present invention is used. The climbing form comprises a beam system 1, a so-called working plane, which is capable to carry below it two or more form halves 2,3. Said form halves 2,3 are supported by means of struts 4,5, the length of which can be adjusted by turning members 6,7, and which are hingedly connected to the beam system 1. The numerals 8,9 designate a railing enclosing different working places. During the casting, the form halves 2,3 are fixed relative to each other, for example, by screw connections 10 and by the struts 4,5. Every form half is hingedly hooked at its upper end 11,12 on the beam system 1.

According to the invention a guide pipe 13 is located between the form halves. The pipe 13 is provided with two axially extending slits 14,15 dividing the pipe into two portions 16,17 of preferably equal size, preferably along a distance shorter than half the pipe length. See FIG. 10, which is enlarged relative to FIG. 1. The slitted pipe portion 18 in FIG. 1 is shown dashed.

The guide pipe 13 is movable relative to the beam system 1 and can be locked axially relative thereto by a drive means 19, which is rigidly secured in the beam system. Said drive means comprises reciprocating hydraulic cylinders 20,21 and a catch jaw 22, which is capable both to drive the pipe 13 in its longitudinal direction and to lock the pipe relative to the beam system 1. During the preferably speed-controlled reciprocating movement of the hydraulic cylinders 20,21, thus, the pipe 13 is lifted by intermittent steps. At the upper end of the pipe 13 a yoke 23 or the like is provided, in relation to which ropes or rods 24,25 are runningly attached. The rods 24,25 extend each through a jaw housing 26,27 attached to the respective piston rod of the hydraulic cylinders 20,21. The jaw housings 26,27 are capable upon said movement of the hydraulic cylinders to climb upward on said rods 24,25. The catch jaw 22 in this connection can be made non-responsive to the movement of the hydraulic cylinders.

A locking device 28 preferably is provided to lock the pipe relative to an underlying cast wall portion of cured concrete. The locking device 28 has the effect that, when the pipe is locked relative to said lastmentioned wall portion and raised with its upper end above the beam system, said jaw housings 26,27 will climb upward along said rods 24,25 whereby the beam system 1 with associated form halves is lifted.

The locking device consists of a locking cotter 28 such as a bolt, shown schematically in FIG. 10, extending through the slits 14,15 of the guide pipe 13 and abutting the upper cured surface of an underlying wall portion.

The locking member 28 may extend through the form halves 2,3 or be designed not extending all the way therethrough. The locking member 28, thus, is capable to abut the underlying cured concrete and the upper end of the slits 14,15 in the pipe 13.

The guide pipe 13 has a length corresponding to at least 1.5 times the height of the form halves 2,3. During the casting operation the guide pipe 13 is located with its upper end above the uppermost level of the form halves, and with its lower end it either projects into a hole 31 formed at the casting of an underlying wall portion 30, see FIG. 2, such a distance that the upward transport of the beam system 1 is guided in the manner described above, and its position relative to the underlying wall portion 30 is stabilized by the guide pipe 13, or at the absence of an underlying wall portion, see FIG. 1, the lower end of the guide pipe is located substantially on the same level as the lowermost level of the form halves.

As appears from FIGS. 5 and 6, arrangements shown in FIG. 1 are positioned equally spaced relative to one another for carrying form halves. The form halves 2,3,2',3',2'',3'' are strutted by beams 32 in known manner. Preferably screw connections 33 are provided centrally on the form halves 2,3,2',3',2'',3'' to fix the halves at the desired distance from each other.

Beams 34 suspending from the beam system 1 are provided for supporting a lower working plane 35.

The invention is described below in connection with the function of the climbing form.

In FIG. 1 a vertical wall is assumed to be cast on a foundation 36. The climbing form is positioned in the manner shown, and the guide pipe 13 is lowered to the foundation 36. Thereafter concrete 37 is poured and allowed to cure. The pipe 13 then is lifted by said drive means 19 to the dashed position 13'. When the pipe has been lifted, the lower end of the pipe is located some distance down into the cured cast concrete 37, see FIG. 2, in the hole 31 formed at the casting. When the pipe has been lifted, the locking member 28 is attached through the slits 14,15 whereby the pipe 13 is locked axially against the underlying wall portion 30 then having been cast. Thereafter the form halves 2,3 are detached and swung outward from the cast wall to a position shown in FIG. 2. The jaw housings 20,21 and therewith the beam system 1 climb upward on the rods 24,25 by the drive means 19 to a position shown in FIG. 3, the rods 24,25 being suspended firmly on the yoke 23 attached to the upper portion of the pipe 13.

It is obvious, thus, that the pipe 13 stabilizes and guides the upward movement of the beam system 1 and the form halves 2,3 and that the pipe constitutes a vertical carrying member for the lifting of the climbing form by the upward movement of the jaw housings on the rods.

In the above description only one pipe 13 and one beam system 1 have been referred to, but of course a plurality of pipes 13, as appears from FIGS. 5, and 6, co-operate for lifting all the climbing forms provided along the wall to be. At the method described above and in the following, preferably said movements of the pipes 13 and beam systems 1 are synchronized to take place simultaneously.

When the beam system has arrived at the position shown in FIG. 3, for form halves 2,3 are fixed in the position shown in FIG. 3. The climbing form, thus, rests on the underlying wall portion 30, into which the pipe 13 is inserted. The rods 24,25 thereafter are lifted to the position shown in FIG. 1 whereafter concrete is poured into the space 38 between the form halves 2,3.

The aforesaid steps are repeated until the wall has been given the desired height.

During the casting of the wall, it is possible to pour concrete either through the upper opening 39 of the pipe or through the slits 14,15 in order to successively fill the hole 31 so that a homogenous concrete wall is obtained.

The reinforcing of a wall under construction simply is carried out by working from above, from the working plane 1, and from the side by working on the working plane 35 when the form halves stand in the position shown in FIG. 2.

The said guide pipe, thus, permits the casting of an entirely plane and straight wall, and the climbing form easily and very accurately to be supported on an underlying cast wall portion. This involves very great savings in respect of struts and stabilizing latticework of wood or steel tubes, as well as savings in respect of erecting and disassembling climbing forms between every casting stage.

The present invention also renders it possible to design the climbing form as described, implying several advantages over known climbing forms. The working planes, for example, participate in the movement and can be adjusted by the drive means to the desired position in height relative to the wall. The form halves can be controlled individually and can easily be designed according to a modular system.

An example of the importance of the latter advantage is shown in FIG. 4 where one of the form halves 40 is given a lower height than the corresponding form half 3, whereby it is possible to cast-in an arch 41 without requiring the climbing form to be dismantled and reassembled in order to start casting from the upper level of the arch and upward. At the casting-in of the arch 41, also the beam 34 carrying the working plane 35 is lifted by a means suitable for this purpose.

in FIGS. 7 and 8 a slipform 50 is shown to which the present invention is applied. A beam system 50 carries at a slipform two form halves 51,52, which also are fixed in position relative to each other by a plurality of stay members generally designated by 53. According to the present invention, the slipform carries a portion 54 intended to carry a lifting means 55, which for example may be a usual small travelling crane.

According to the present invention, a guide pipe 56 is provided between the two form halves 51,52. The guide pipe is movable by the lifting means 55 relative to said beam system 50. The lifting means 55 and said portion 54 are capable to lift the guide pipe 56 at minimum to a position, in which its lower end 57 is located above the upper surface 58 of the form halves 51,52. Jacks 60 further are provided to lift at casting the entire slipform in co-operation with climb pipes 61.

The guide pipe 56 preferably can be locked also in connection with slipforms relative to the beam system 50, by a locking means (not shown).

At slipform casting it is necessary, for preventing deviations in vertical direction of the wall being cast, to stabilize the slipforms relative to each other in horizontal direction by means of extensive and expensive latticework or by a rigid plane, which is assembled and anchored in the slipforms.

At large projects said latticework or planes are constructed of steel beams. The aforesaid, of course, also applies when only one slipform is used.

In FIG. 8 a view is shown at which a slipform is applied. Owing to the present invention, the upward movement of the slipform is guided by the guide pipe 56, which also stabilizes the slipform in horizontal direction against a.o. wind forces. The guide pipe in this connection, thus, shall have such a length that it projects down into the cured concrete such a distance, that the stresses on the pipe 56 in horizontal direction do not affect the cast concrete or the position of the slipform. At slipforms the guide pipe 56 preferably is not provided with slits.

At slipforms the guide pipe must permit to be lifted entirely in order not to be cast-in in the cast concrete.

In a manner corresponding to what has been said above with respect to climbing forms, concrete can be poured in said pipe in order to fill the hole 59 formed by the pipe 56 with concrete, so that a homogenous wall is obtained.

By the present invention applied to slipforms a high precision with respect to deviation in horizontal direction of cast walls can be obtained, because erected conventional latticework constructions or planes can be deformed and require accurate synchronization between the upward movement of the different jointed slipforms, so that no inclination of one of more slipforms can occur.

The present invention, thus, implies a great progress in casting technology, partly because substantial cost savings are possible in respect of struts and latticework for stabilizing and fixing climbing forms and slipforms, and because the precision in respect of the deviation of the cast wall in vertical direction can be improved. The invention, further, implies less work with forms and form struts, so that the casting can be carried out more rapidly.

The pipe instead of being provided with slit can be provided with a plurality of holes when it is intended to be used for climbing forms, or it can be provided with slit when to be used for slipforms. The pipe, further, may have a cross-section different of that shown. The guide pipe also can be used at many types of climbing forms, slipforms, platform forms etc., where the guide pipe implies a guiding of the form by its insertion into cured concrete in the manner described above.

The present invention, thus, must not be regarded restricted to the embodiments described above, but can be varied within the scope of the attached claims.

I claim:

1. An arrangement for casting concrete walls, comprising a beam system (1,50), a so-called working plane, which beam system is capable to carry below it via struts (4,5,53) two form halves (2,3,51,52), between which concrete is to be poured, characterized in that a guide pipe (13,56) is located between the form halves and can be moved and locked relative to and at said beam system (1,50) that the pipe (13,56) has a length corresponding to at least 1.5 times the height of the form halves (2,3,51,52), which guide pipe (13,56) during the casting is located with its upper end above the uppermost level of the form halves (2,3,51,52) and with its lower end either projects down into a hole (31) formed at the casting of an underlying wall portion (30) such a distance, that the upward transport of the beam system (1,50) is guided and its position relative to the underlying wall portion (30) is stabilized by means of said guide pipe (13,56), or at the absence of an underlying wall portion with its lower end is located substantially on the same level as the lowermost level of the form halves.

2. An arrangement as defined in claim 1, characterized in that the guide pipe (13,56) is provided with axially extending slits (14,15) dividing the pipe (13,56) into two preferably equal-sized portions along a portion of the pipe length, preferably along a distance shorter than half the pipe length.

3. An arrangement as defined in claim 1 or 2, in the case the arrangement is intended to be used at so-called climbing forms, characterized in that the guide pipe (13) can be moved and locked relative to said beam system (1) by a drive means (19) rigidly secured in the beam system, which drive means comprises reciprocating hydraulic cylinders (20,21) and a catch jaw (22), which is capable to drive the pipe (13) in its longitudinal direction and to lock the pipe, that the pipe at its upper end is provided with a yoke (23) or the like, which carries rods (24,25) or ropes, each running through a jaw housing (26,27) attached to the repsective piston rod of the hydraulic cylinders (20,21), which jaw housings (26,27) are capable upon the movement of the hydraulic cylinders to climb upward on said rods (24,25), and a locking means (28) is provided to lock the pipe (13) relative to an underlying wall portion (30) of cured concrete, and that, when the pipe (13) is locked relative to said last-mentioned wall portion (30) and said jaw housings (26,27) climb upward on said rods (24,25), the beam system (1) with associated form halves (2,3) is lifted by means of said rods (24,25).

4. An arrangement as defined in claim 3, characterized in that said locking means (28) consists of a locking cotter such as a bolt, which extends through the slits (14,15) of the guide pipe and abuts the upper cured surface of an underlying wall portion (30).

5. An arrangement as defined in claim 1 or 2, in the case the arrangement is used at so-called slipforms, characterized in that the guide pipe (56) can be moved relative to said beam system (50) by a lifting means (55), which is capable at minimum to lift the lower end (57) of the guide pipe (56) above the upper surface (58) of the form halves (51,52).

* * * * *